United States Patent [19]

Troy

[11] Patent Number: 4,637,347

[45] Date of Patent: Jan. 20, 1987

[54] IMPROVED CONTINUOUS LOW FLUID EXCHANGE WATER HEATER

[76] Inventor: Leonard Troy, 212 Glenburn Rd., Clarks Summit, Pa. 18411

[21] Appl. No.: 756,322

[22] Filed: Jul. 18, 1985

[51] Int. Cl.[4] ..... F22B 21/00

[52] U.S. Cl. ..... 122/20 A; 122/13 R; 122/234; 122/249; 165/74; 237/19

[58] Field of Search ..... 122/4 A, 13 A, 13 R, 122/20 A, 234, 247, 249, 332, 364, 365; 165/73, 74 X, 75; 237/19; 126/361, 427

[56] References Cited

U.S. PATENT DOCUMENTS

| | | | |
|---|---|---|---|
| 1,451,863 | 4/1923 | Clark | 122/13 A |
| 2,501,012 | 3/1950 | St. Clair | 165/74 X |
| 3,269,141 | 8/1966 | Weiss | 165/74 X |
| 4,282,421 | 8/1981 | Hadar | 122/13 A X |
| 4,296,799 | 10/1981 | Steele | 165/74 |
| 4,514,617 | 4/1985 | Amit | 122/13 A X |

FOREIGN PATENT DOCUMENTS

| | | | |
|---|---|---|---|
| 2450847 | 5/1975 | Fed. Rep. of Germany | 126/361 |

*Primary Examiner*—Albert J. Makay

*Assistant Examiner*—Steven E. Warner

*Attorney, Agent, or Firm*—Aaron B. Karas

[57] ABSTRACT

This invention relates to an improved hot water heater and more particularly to a hot water heater which is normally utilized in conjunction with a hydronic boiler. The hot water heater has a single opening which is closed by a removable cover plate. The tank is provided with a corrosion resistant lining which also defines the opening and is so related to the tank so as to resist fracture under normal usage. The single cover plate carries all fluid connections of the tank and by removing the cover plate, all components of the hot water heater may be removed from within the tank for repair or replacement. The components carried by the cover plate include a hot water supply pipe or tube which extends through the heat exchange coil and terminates in an opening near the top of the tank. This tube or pipe is preferably formed of an insulated material or is insulated so that hot water passing therethrough is not cooled by the colder water in the bottom of the tank. The hot water temperature control (thermostat) may optionally be of the surface-mounted type.

6 Claims, 3 Drawing Figures

FIG. 1
(PRIOR ART)
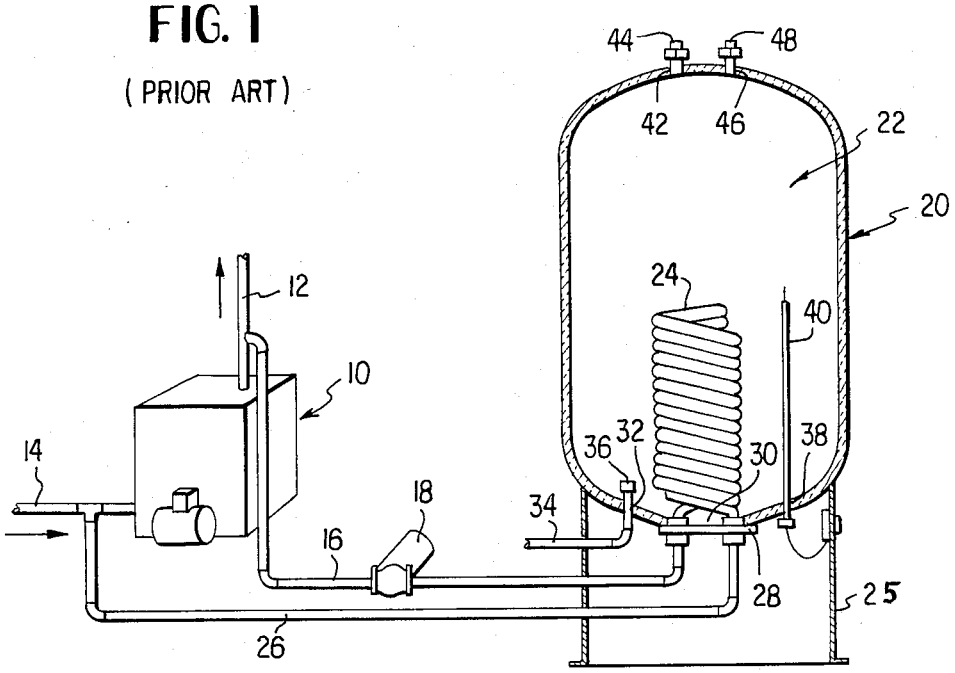
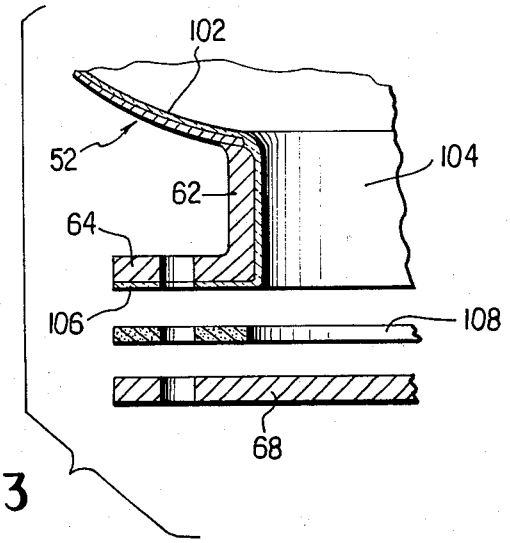
FIG. 3

IMPROVED CONTINUOUS LOW FLUID EXCHANGE WATER HEATER

This invention relates to useful improvements in domestic water heaters, and more particularly to an improved water heater of the type having an internal fluid heat exchange unit.

Providing domestic hot water for a typical household has been taking an increasingly larger share of the household energy budget. While hydronic heating systems are becoming more and more efficient and while homes are being better insulated than ever before, most domestic hot water is provided by inherently inefficient gas hot water heaters of the type having a flue extending through the center of the water storage tank which siphon the heat out of the storage tank as soon as the burner is satisfied and shuts off. Another type of water heater is the inherently inefficient electric water heater wherein several BTU's of heat must be expended in the electrical generating plan to produce one BTU of heat in the domestic hot water heater.

It is possible to utilize a modern high efficiency hydronic boiler to very efficiently provide domestic hot water by utilizing a storage tank in combination with an internal heat exchanger. This would usually be the same boiler that is used to heat the home and provide other space heating. Thus, when there is a need for more domestic hot water (as determined by a water temperature thermostat located so as to sense the temperature of the water in the storage tank) then the hydronic boiler is switched on and hot water from the boiler is pumped through the heat exchanger coil in the storage tank, thus heating the domestic hot water in the storage tank by conduction.

There are other hot water heaters of this type on the market. However, they have serious deficiencies which this invention corrects. For example, most currently available domestic hot water heaters have at least one connection going through the top of the tank. This provides an extra location for tank deterioration and failure to occur.

Many or most hot water heater failures occur at a location where a pipe, a flue or an electrical component goes through an otherwise unbroken surface of the tank. An opening in the top portion of the tank is particularly subjected to deterioration since heated water rises and the hottest water in a storage tank is at the top. Furthermore, fittings and pipes at the top of the tank draw heat from the water and dissipate the heat to the surrounding air. These construction features of other domestic water heaters render them difficult to repair.

In accordance with the practice of this invention, there is provided a tank for a water heater which has only a single opening, with this opening positioned at the bottom thereof and wherein all components of the heater are carried by a cover plate for this opening. Thus, when any part of the hot water heater, with the exception of the tank, becomes defective, that part, together with all other internal parts of the hot water heater may be removed by removing the cover plate and the defective part repaired or replaced.

IN THE DRAWINGS:

FIG. 1 is a view of a hydronic boiler having coupled thereto a domestic hot water heater of a known type.

FIG. 3 is an enlarged fragmentary vertical sectional view showing the internal construction of the tank of this invention including a mounting flange for a cover plate, the cover plate and an associated gasket.

Figure 2:
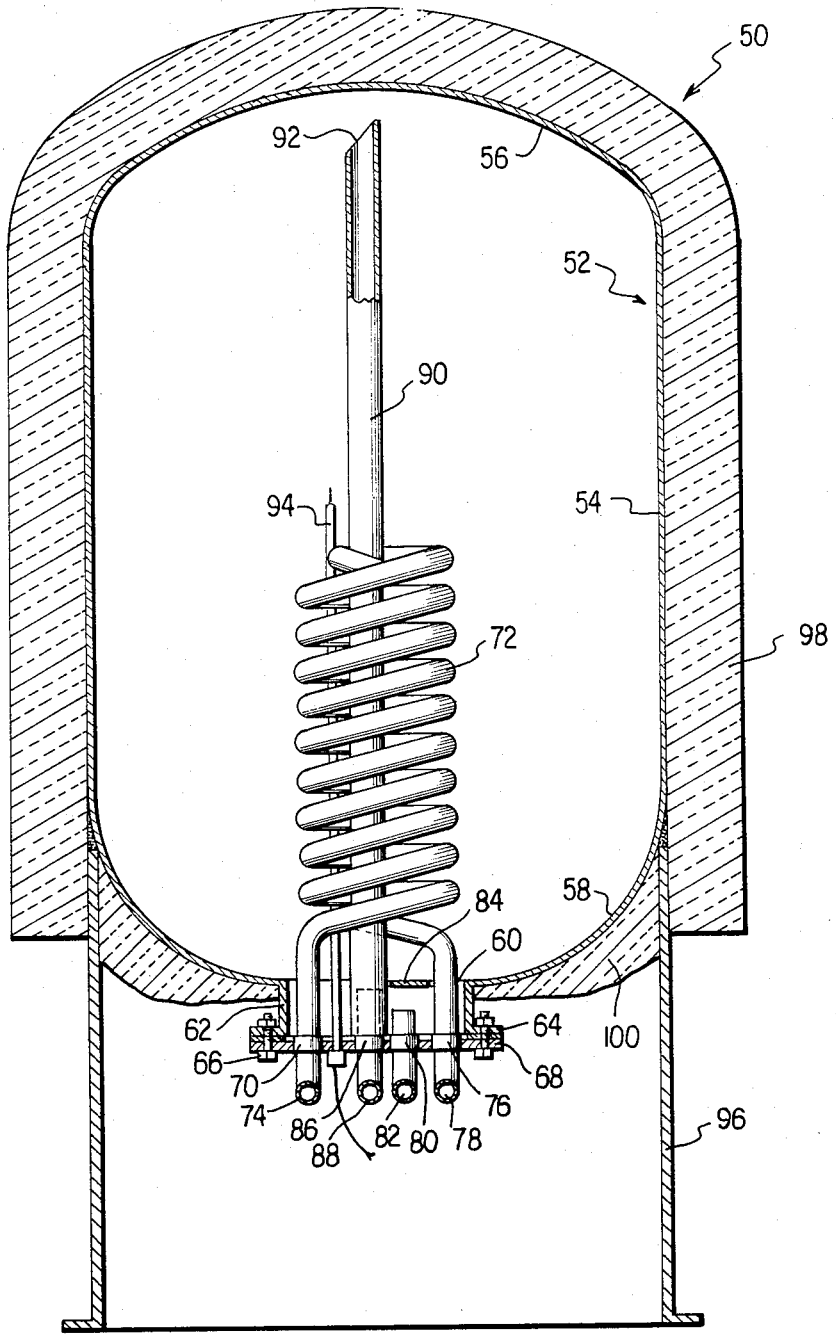
FIG. 2 is an enlarged fragmentary vertical sectional view through a hot water heater formed in accordance with this invention.

Referring now to the drawings in detail, reference is first made to FIG. 1 wherein a typical prior art construction is shown. FIG. 1 illustrates a conventional hydronic boiler generally identified by the numeral 10. The boiler 10 has a hot water supply pipe 12 (for supplying hot water to radiators for example) and a water return pipe 14 (to receive water from the radiators). The hot water supply pipe 12 has coupled thereto a supply pipe 16 which there carries a pump unit 18. The supply pipe 16 leads to a domestic hot water heater generally identified by the numeral 20.

The domestic hot water heater of FIG. 1 includes a storage tank, generally identified by the numeral 22 which may be of the glass lined, externally insulated type or any other suitable type. The storage tank 22 is carried by a supporting skirt or base 24.

The hot water heater 20 has a heating element in the form of a heat exchanger coil 24 to which is connected the supply pipe 16. A return line 26 extends from the exchanger coil 24 to the return line 14.

It is to be noted that the heat exchanger coil 25 is carried by a removable cover plate 28 which closes a large opening 30 in a bottom portion of tank 22. In this manner the heat exchanger coil 25 may be repaired or replaced as it may be necessary.

In addition to the large opening 30, the bottom portion of the tank 22 is provided with an opening 32 for a water supply line 34 for the hot water heater 20. The water supply line 34 may be provided with a diffuser 36 at its end within the tank 22.

There is also an opening 38 in the bottom portion of the tank 22 for an electrical water temperature thermostat 40.

Normally there will be two openings in the top portion of tank 22. These openings include an opening 42 for a hot water delivery line 44 and opening 46 for a line 48 which will carry a temperature relief valve and/or a pressure relief valve (not shown).

It will thus be seen that the tank 22 requires in addition to the central bottom opening 30, openings 36, 38, 42 and 46 wherein faults may occur in the lining of tank 22.

Reference is now made to FIGS. 2 and 3 wherein there is illustrated a hot water heater which is an improvement over that shown in FIG. 1. The hot water heater of this invention is generally identified by the numeral 50. The hot water heater 50 includes a tank 52, having a generally cylindrical body 54, an arched or bowed top wall 56 and a similar bowed bottom wall 58. The bottom wall 58 has a large single opening 60 therethrough defined by a depending collar 62 carrying an outwardly extending flange 64. The flange 64 has removably secured thereto by way of a plurality of bolts or like fasteners 66, a cover plate 68. The cover plate 68 closes the single opening 60 and carries all internal components of the hot water heater.

As is clearly shown in FIG. 2, the cover plate 68 carries a connection 70 for supplying hot water to a heat exchanger coil 72, the hot water supply connection 70 being coupled to a hot water supply line 74 similar to the line 16 of FIG. 1.

The cover plate 68 also carries a connection 76 for receiving return water from the coil 72 with the connection 76 having coupled thereto a pipe or line 78 for returning the hot water to the boiler 10, the line 78 corresponding to the line 26 of FIG. 1.

The cover plate 68 also carries a connection 80 for a water supply pipe 82 (corresponding to water supply line 34 of FIG. 1) for directing water into the tank 52. A suitable diffuser or like deflector plate 84 is mounted above the free end of the connection 80 for preventing the supply water from passing directly into the upper part of tank 52.

There is also a connection 86 carried by and extending through the cover plate 68 for a hot water supply line 88, line 88 corresponding to line 44 of FIG. 1. The connection 86 has connected thereto a pipe 90 which extends vertically through the coil 72 and has an entrance opening 92 adjacent the top wall 56 of the tank 52. The pipe 90 may be formed of a suitable insulating material, such as plastic, or may be a metal tube having insulation thereabout. The purpose of the tube 90 being insulated is that as hot water is drawn from the top of the tank 52, cold water enters into the bottom of the tank and the pipe 90 must pass down through that cold water. The insulation prevents the removal of heat from the hot water passing down through the pipe 90 by the surrounding cold water. This insulation is optional.

It is also to be understood that the cover plate 68 will carry other types of connections and fitments normally found in hot water tanks. For example, there is illustrated a water temperature thermostat 94. There may also be a connection (not shown) carried by the cover plate 68 for a temperature relief valve and/or pressure relief valve. Further, the tank 52 may be provided with an electric resistance heating element (not shown) of a conventional type to provide supplemental hot water or emergency hot water when the source of hot water hydronic boiler 10 is not operable. Such an electric resistance heating element would also be carried by the cover plate 68.

It thus will be apparent that the tank 52 requires but a single opening 60 and this is easily sealed by the cover plate 68. Since the tank 52 has but a single opening 60 and this will be protected in a manner which will be described hereinafter, it will be readily apparent that the tank 52 is considerably more resistant to normal failure.

At the same time, since all of the connections for the hot water heater 50 are carried by the cover plate 68, should there be any failure of any component, it is merely necessary to drain the tank, remove the cover plate 68 and then repair or replace the failed component.

Tank 52 is optionally supported by a cylindrical lower skirt or base 96. The skirt 96 not only provides a support for the tank 52 but also protects the cover plate 68 and the various pipes and fittings carried thereby.

Tank 52 is primarily insulated by an exterior insulating cover 98. However, there is optional supplemental insulation 100 within the skirt 96 covering the bottom wall 58 surrounding the collar 62.

Referring now to FIG. 3 there is illustrated in greater detail the lower portion of tank 52 but without the insulation 100. it is to be noted that the tank 52 may be formed of metal and may have a corrosion resistant lining 102 which may be in the form of glass but could be in the form of other corrosion resistant material such as stone or plastic. It is to be particularly noted that the lining 102 includes a continuous cylindrical portion 104 which lines the collar 62. The lining 102 also includes an annular portion 106 which covers that surface of flange 64 which opposes the cover plate 68. The liner portion 106 is continuous with the liner portion 104. Thus there are no interruptions in the protective coating for the interior of the tank 52. Alternatively, the tank may be formed of other material such as corrosion resisting metal (e.g., stainless steel or a copper alloy or a non-metallic material such as an engineering plastic). This could eliminate the need for lining 102, 104, 106.

It is seen that there is interposed between the cover plate and the liner portion 106 a gasket 108 which is formed of a soft, seal forming material such as an elastomer composition, which will protect the lining 106 from fracture.

The flange 64, the liner portion 106, the gasket 108 and the cover plate 68 are provided with aligned openings for the bolts or other type fasteners 66.

Although only a preferred embodiment of the improved hot water heater has been specifically illustrated and described herein, it is to be understood that minor variations may be made in the hot water heater construction without departing from the spirit and scope of this invention as defined by the appended claims.

A zoning system may be incorporated in the boiler hot water circuitry wherein the flow of hot water to the heat exchanger coil 14 is terminated when the heating requirements of the water heater are satisfied—even though the hydronic boiler continues to operate to supply space heating needs. This is not illustrated since the principles involved are well-known in this art.

The water temperature control (thermostat) may optionally be of the surface-mounted type. Further, the diameter of the cover plate 68, although shown to be considerably smaller than the tank may be considerably larger. In fact, it may be so large as to not require that the tank be necked down. Also, the collar 62 be of the same diameter as tank 52, thus simplifying manufacturing operations.

What is claimed is:

1. A water heater of the continuous flow, fluid heat exchange type wherein the boiler used to heat the heat exchange fluid is a separately contained unit connected by pipe means to said water heater, said water heater comprising a tank having a single opening, the opening located at the bottom of the tank, a removable cover plate releasably sealing said opening, and all fluid connections to said tank being carried by said cover plate, one of said connections including a hot water outlet, said hot water outlet including an insulated elongated tube extending into an upper most section of said tank.

2. A water heater according to claim 1 wherein there is a gasket between said tank and said cover plate surrounding said single opening.

3. A water heater according to claim 1 wherein said single opening is defined by a collar and a flange, said flange having an outer surface facing said cover plate, said tank having an internal lining of a corrosion resistant material, and said lining extending over said collar and said flange outer surface.

4. A water heater according to claim 1 wherein there is a supporting skirt depending from a bottom portion of said tank for supporting said tank and protecting said cover plate and said connections, and there is insulation within said skirt covering said tank bottom portion.

5. A water heater according to claim 1 wherein said connections include connections for a fluid type heater exchanger disposed within said tank, said connections further include a connection for a water temperature thermostat positioned within said tank.

6. A water heater according to claim 1 wherein said cover plate is formed of a corrosion resistant metal.

* * * * *